US007908825B2

(12) United States Patent
Stiller et al.

(10) Patent No.: US 7,908,825 B2
(45) Date of Patent: Mar. 22, 2011

(54) METHOD AND DEVICE FOR PRODUCING CIGARETTE PACKS

(75) Inventors: Martin Stiller, Verden (DE); Burkard Roesler, Blender (DE); Jens Schmidt, Grasberg (DE); Jürgen Schwecke, Hilgermissen (DE)

(73) Assignee: Focke & Co. (GmbH & CO. KG), Verden (DE)

( * ) Notice: Subject to any disclaimer, the term of this patent is extended or adjusted under 35 U.S.C. 154(b) by 211 days.

(21) Appl. No.: 12/301,908

(22) PCT Filed: Apr. 3, 2007

(86) PCT No.: PCT/EP2007/002967

§ 371 (c)(1),
(2), (4) Date: Nov. 21, 2008

(87) PCT Pub. No.: WO2007/134669

PCT Pub. Date: Nov. 29, 2007

(65) Prior Publication Data

US 2010/0242412 A1 Sep. 30, 2010

(30) Foreign Application Priority Data

May 23, 2006 (DE) ..... 10 2006 024 559

(51) Int. Cl.
*B65B 53/02* (2006.01)

(52) U.S. Cl. ..... 53/442; 53/557

(58) Field of Classification Search ..... 53/442, 53/53, 54, 557, 202; *B65B 53/02*
See application file for complete search history.

(56) References Cited

U.S. PATENT DOCUMENTS

| | | | | |
|---|---|---|---|---|
| 2,037,631 | A | 4/1936 | Hultin | |
| 4,134,502 | A * | 1/1979 | Seragnoli | 53/54 |
| 4,530,199 | A * | 7/1985 | Manservisi et al. | 53/53 |
| 5,101,609 | A * | 4/1992 | Cook | 53/53 |
| 5,155,979 | A * | 10/1992 | McDonald | 53/202 |
| 5,544,470 | A * | 8/1996 | Yarbrough | 53/442 |
| 5,680,745 | A * | 10/1997 | Brizzi et al. | 53/53 |
| 5,769,599 | A | 6/1998 | Schnabel et al. | |
| 6,047,526 | A * | 4/2000 | Draghetti | 53/202 |
| 6,158,193 | A * | 12/2000 | Focke et al. | 53/53 |
| 6,511,405 | B1 * | 1/2003 | Focke et al. | 53/557 |
| 6,564,527 | B1 * | 5/2003 | Focke et al. | 53/53 |
| 7,784,253 | B2 * | 8/2010 | Blome | 53/557 |
| 2005/0198928 | A1 * | 9/2005 | Boriani et al. | 53/442 |
| 2006/0090423 | A1 * | 5/2006 | Assirelli et al. | 53/442 |
| 2006/0130433 | A1 * | 6/2006 | Wilder et al. | 53/442 |

FOREIGN PATENT DOCUMENTS

| | | | |
|---|---|---|---|
| CN | 1276323 | A | 12/2000 |
| DE | 32 19 001 | A1 | 12/1982 |
| DE | 33 47 344 | A1 | 6/1984 |
| DE | 196 42 373 | A1 | 4/1997 |

(Continued)

*Primary Examiner* — Stephen F Gerrity
(74) *Attorney, Agent, or Firm* — Sughrue Mion, PLLC

(57) ABSTRACT

Cigarette packs of the hinge-lid-box type with an outer wrapping of shrinkable film are transported through a shrinkage station (22) in two pack rows (26, 27), in each case comprising individual packs. In the region of said shrinkage station, shrinkage elements, namely heating plates (24, 25; 45, 46), subject the upper side and/or lower side of the packs (10), during a standstill phase of the same, to (contact) heat. The packs (10) are transported such that the lower side and the upper side are simultaneously or consecutively exposed for contact by the heating plates.

5 Claims, 8 Drawing Sheets

FOREIGN PATENT DOCUMENTS

Figure 1:
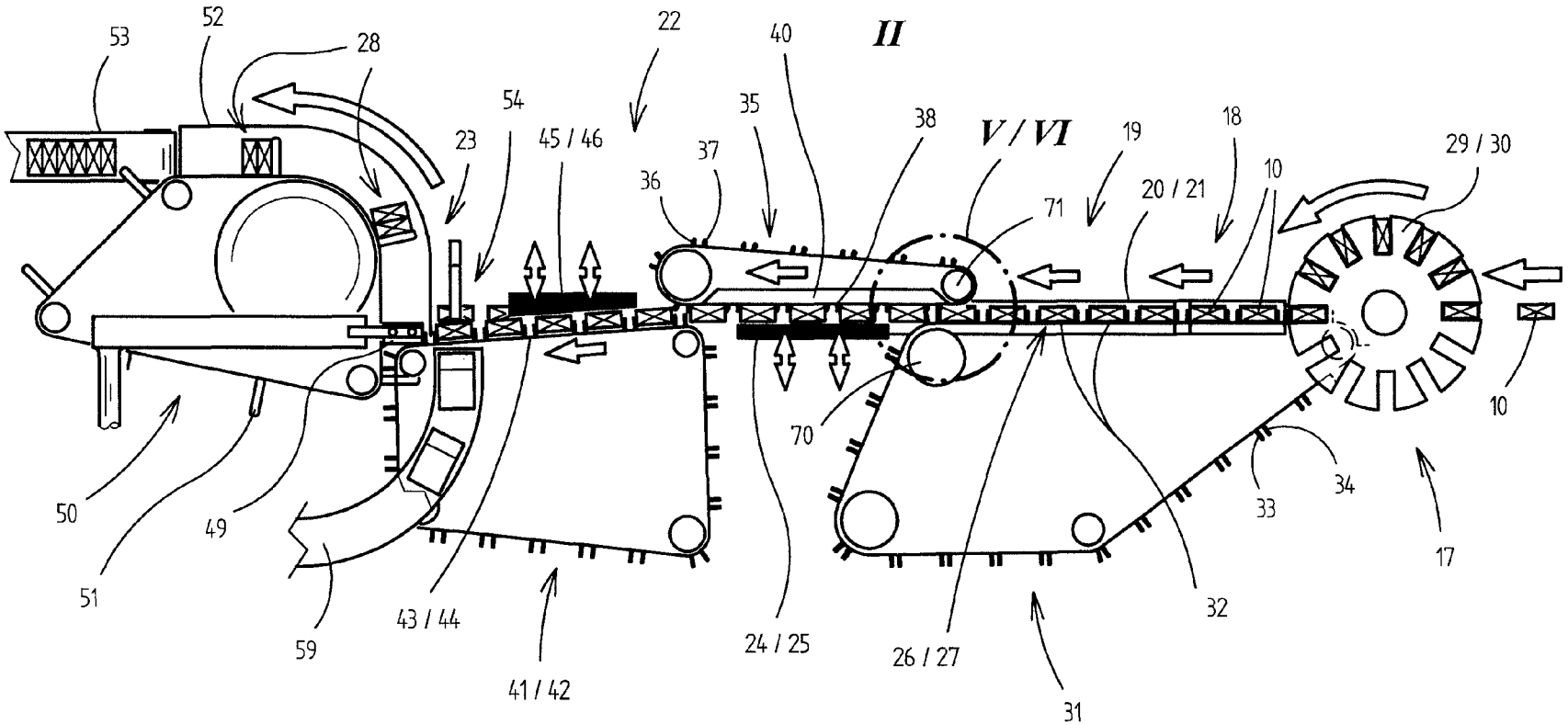

| | | | | |
|---|---|---|---|---|
| DE | 195 46 055 | A1 | | 6/1997 |
| DE | 34 48 580 | C2 | | 6/1998 |
| DE | 199 57 415 | A1 | | 5/2001 |
| EP | 0 778 205 | A | | 6/1997 |
| EP | 0 842 853 | A1 | | 5/1998 |
| EP | 1 055 603 | A1 | | 11/2000 |
| EP | 1 084 954 | A2 | | 3/2001 |
| EP | 1 574 437 | A1 | | 9/2005 |
| EP | 1 652 772 | A1 | | 5/2006 |
| EP | 1 693 298 | A1 | | 8/2006 |
| JP | 04294704 | A | * | 10/1992 |

* cited by examiner

METHOD AND DEVICE FOR PRODUCING CIGARETTE PACKS

CROSS REFERENCE TO RELATED APPLICATION

This application is a National Stage of International Application No. PCT/EP2007/002967 filed Apr. 3, 2007, claiming priority based on German Patent Application No. 10 2006 024 559.8, filed May 23, 2006, the contents of all of which are incorporated herein by reference in their entirety.

Description

The invention relates to a method for producing (hard) packs, in particular cigarette packs of the hinge-lid-box type, with an outer wrapping of shrinkable film, wherein the packs which are provided with the outer wrapping are transported through a shrinkage station having heat elements, in particular having heating plates, for transmitting shrinkage heat to the packs. Furthermore, the invention relates to an apparatus for carrying out the method.

The shrinkage treatment of cigarette packs of the hinge-lid-box type with an outer film wrapping is known in principle. In the case of the apparatus according to one above another in a sealing sequence past heating plates. During a standstill phase, heat is transmitted to the upwardly directed large-surface-area pack sides, namely the front side or rear side with the packs lying one above another. The handling of the heating plates is difficult because of the arrangement between the pack rows lying one above another.

The invention is based on the object of proposing a method and apparatus for producing in particular cigarette packs, including shrinkage treatment, in which a high degree of efficiency with a precise result from the treatment are ensured.

To achieve this object, the method according to the invention is characterized by the following features:

a) the packs are transported through the shrinkage station in two rows of individual packs lying next to each other, in particular in parallel, namely pack rows, b) downstream of the shrinkage station the adjacent, mutually assigned packs of the two rows are brought together by transverse displacement with groups of in each case two packs lying one above the other being formed.

For the further processing of the packs, namely for the production of customary multipacks, "cigarette multipacks", it is indispensable for the packs to be formed in groups of packs having their front side and rear side in contact with one another. This formation has proven disadvantage for the shrinkage process. Accordingly, for this region, the packs are conveyed and treated individually in two (parallel) pack rows and are then brought together with (two) groups being formed.

Accordingly, the apparatus according to the invention is provided, at least in the region of a shrinkage station, with two parallel pack conveyors which each convey one pack row, wherein, during a momentary standstill, in the region of the shrinkage elements, in particular the heating plates assigned to each pack row, the heating plates obtain contact with the upper side and/or lower side of the packs in order to transmit the predetermined shrinkage heat.

The pack conveyors are designed in such a manner that the lower side, namely front side or rear side of the packs, is free for contact by the heating plates. For this purpose, the packs are held on a pack conveyor, which runs above the packs or next thereto, by means of suction air and/or by means of mechanical holding elements.

In the positioning of the packs, which are supplied in two rows, in groups of packs lying one above another, there is a particular characteristic in that the packs arrive in offset planes in the region of a grouping station, to be precise in particular by means of pack conveyors which run with an upwardly directed or downwardly directed inclination and the vertical spacing of which substantially corresponds to the height of an individual pack in the region of a transverse displacement of the packs.

Figure 2:
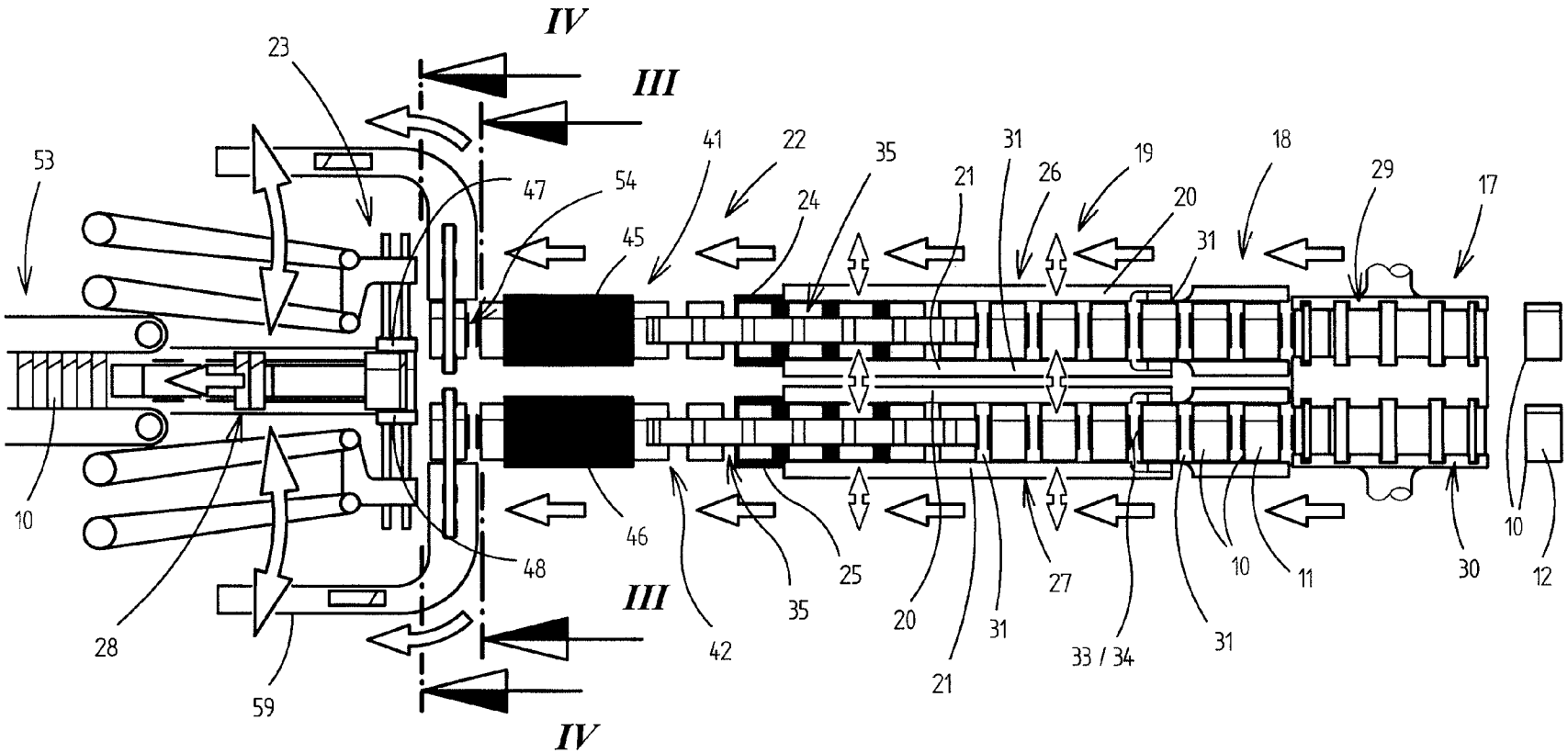
Figure 3:
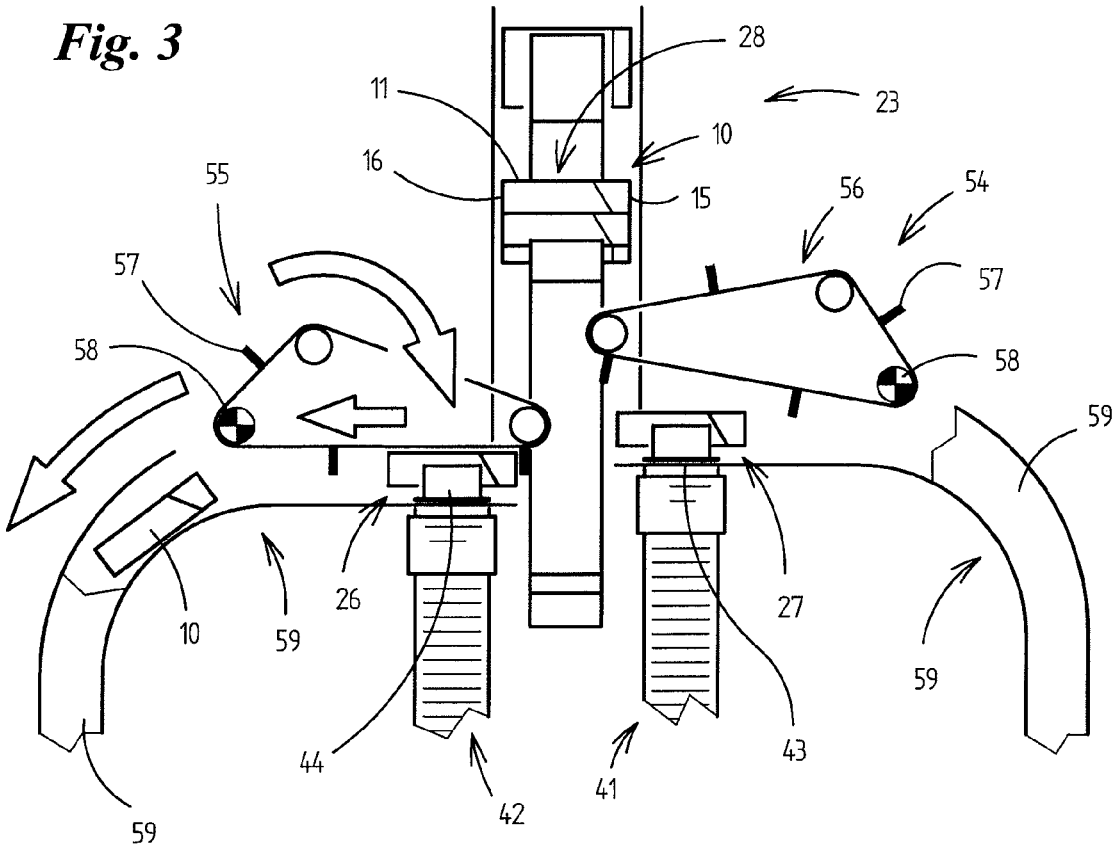
Figure 4:
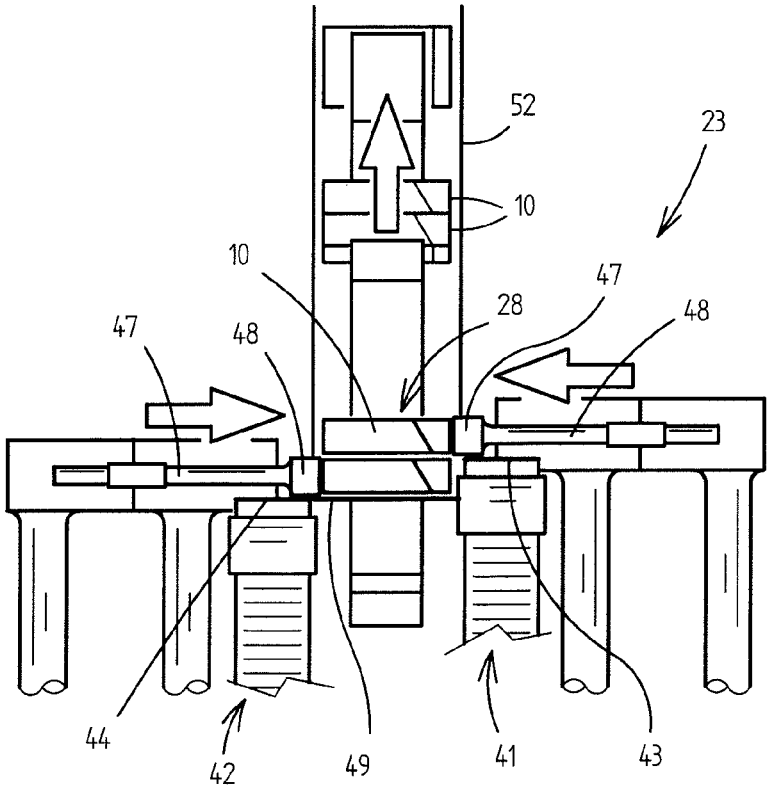
Figure 5:
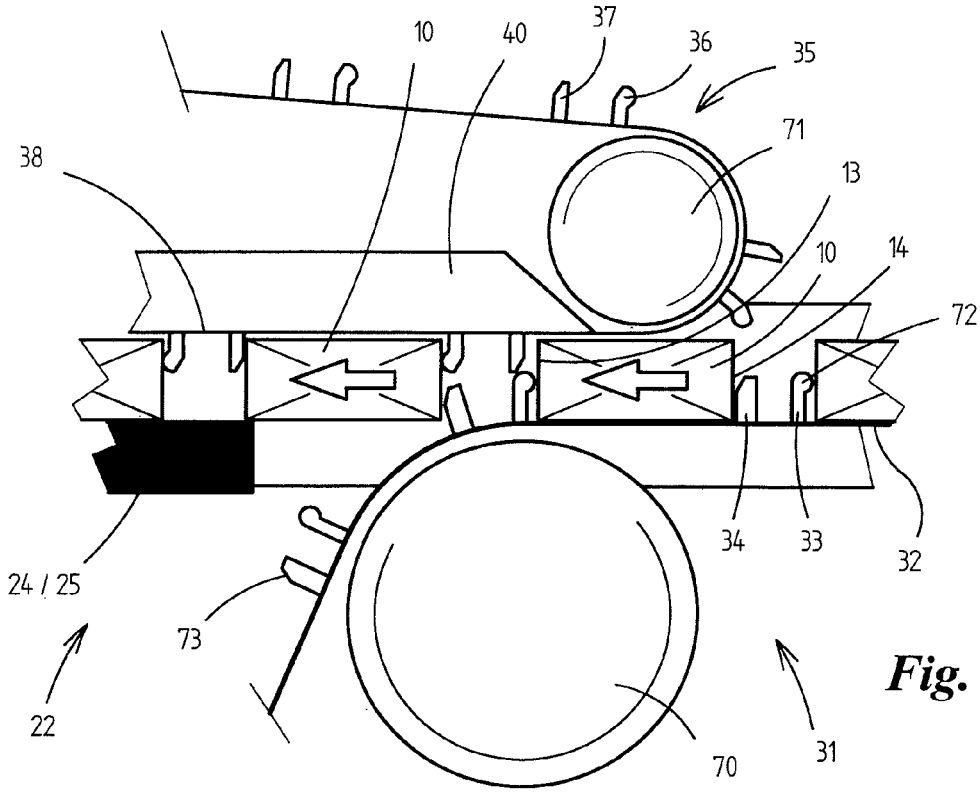
Figure 6:
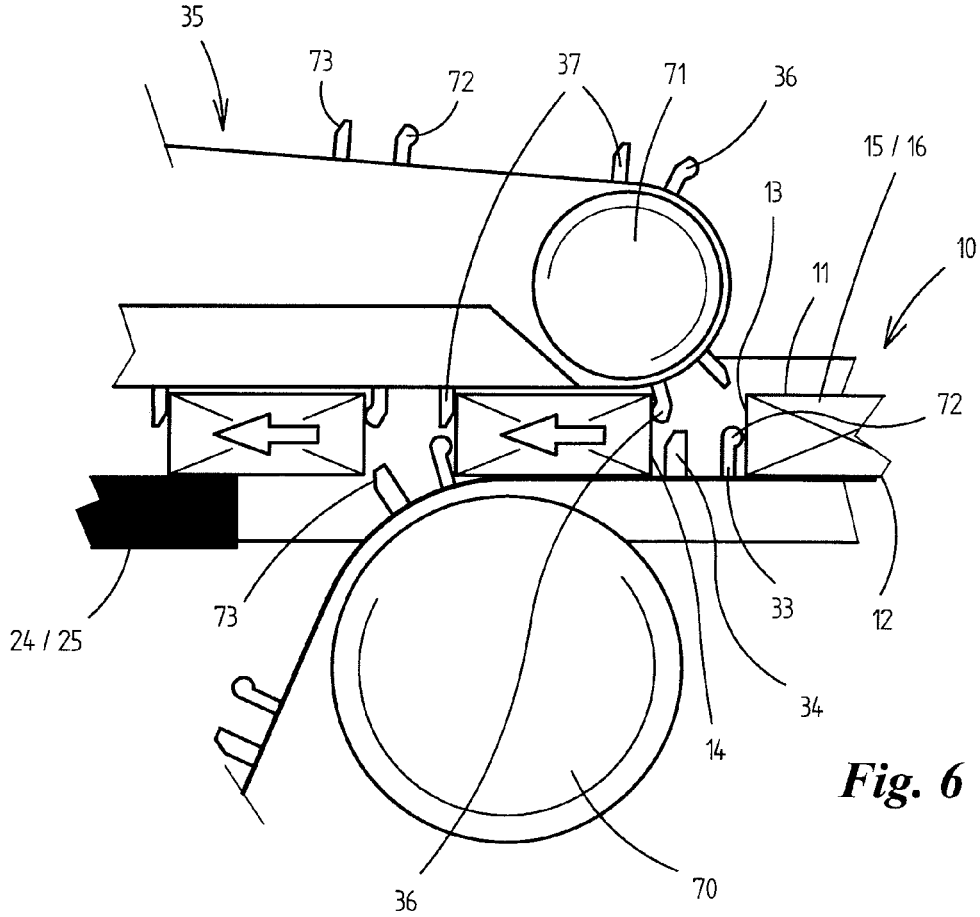
Figure 7:
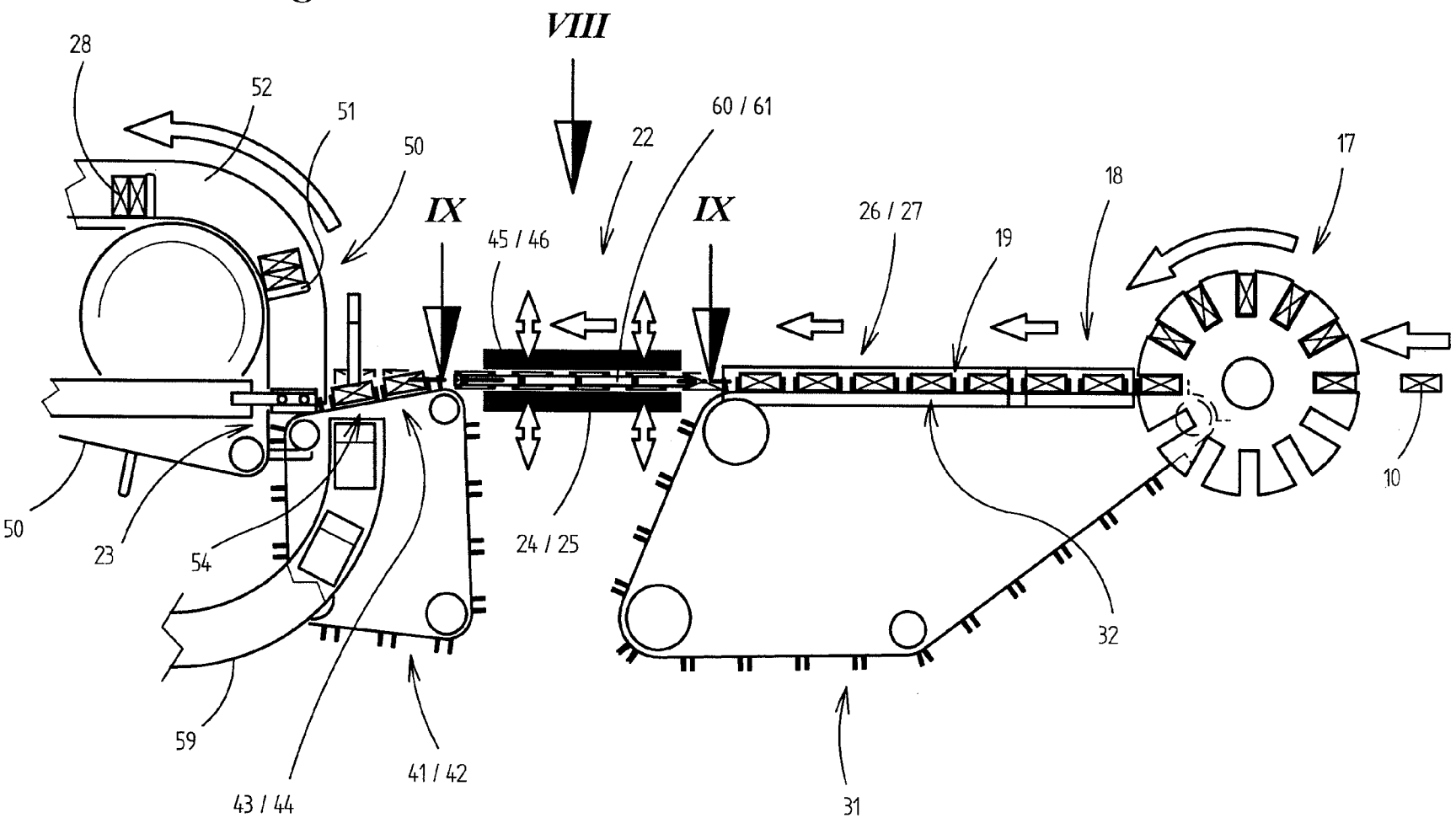
Figure 8:
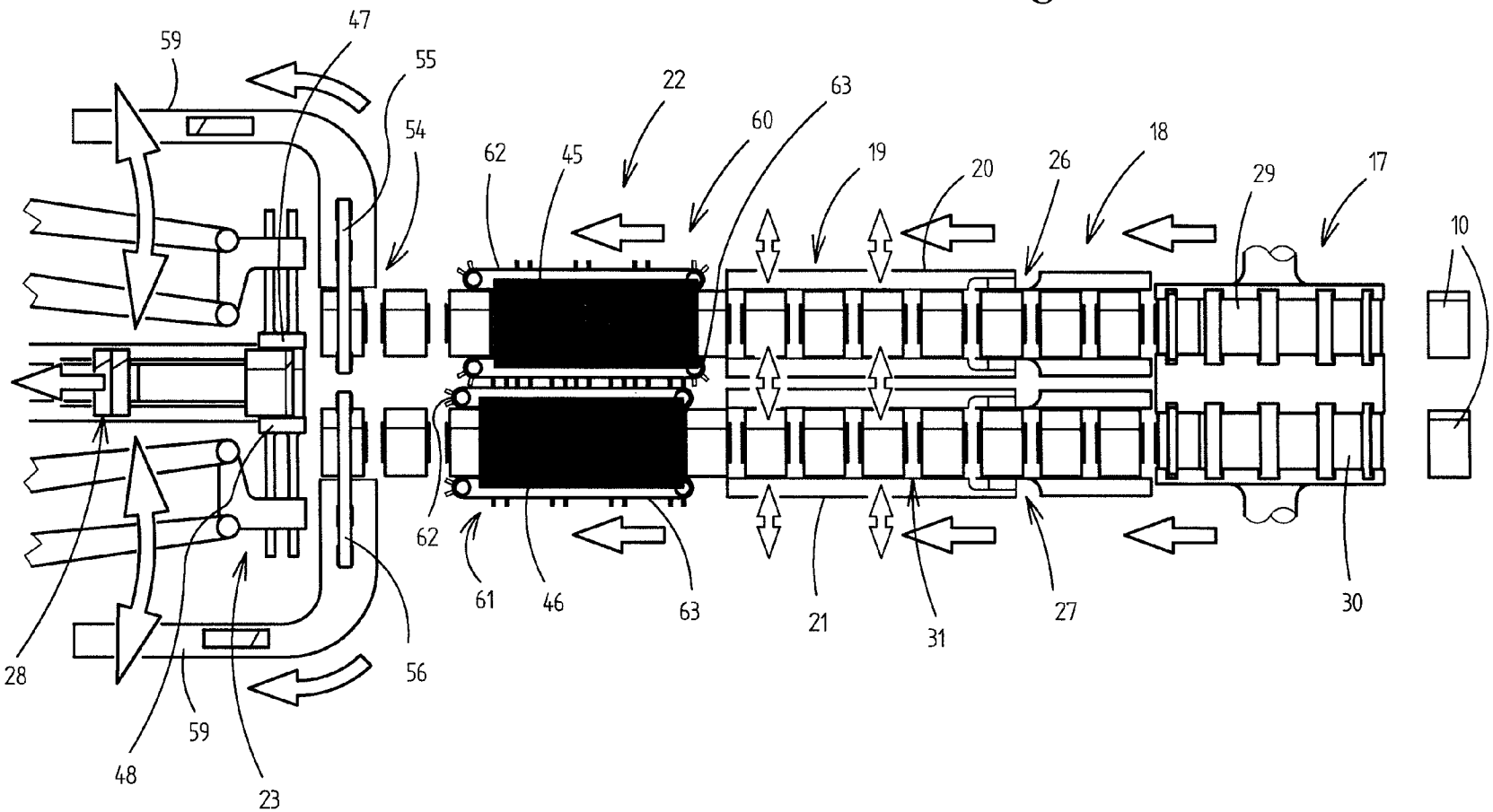
Figure 9:
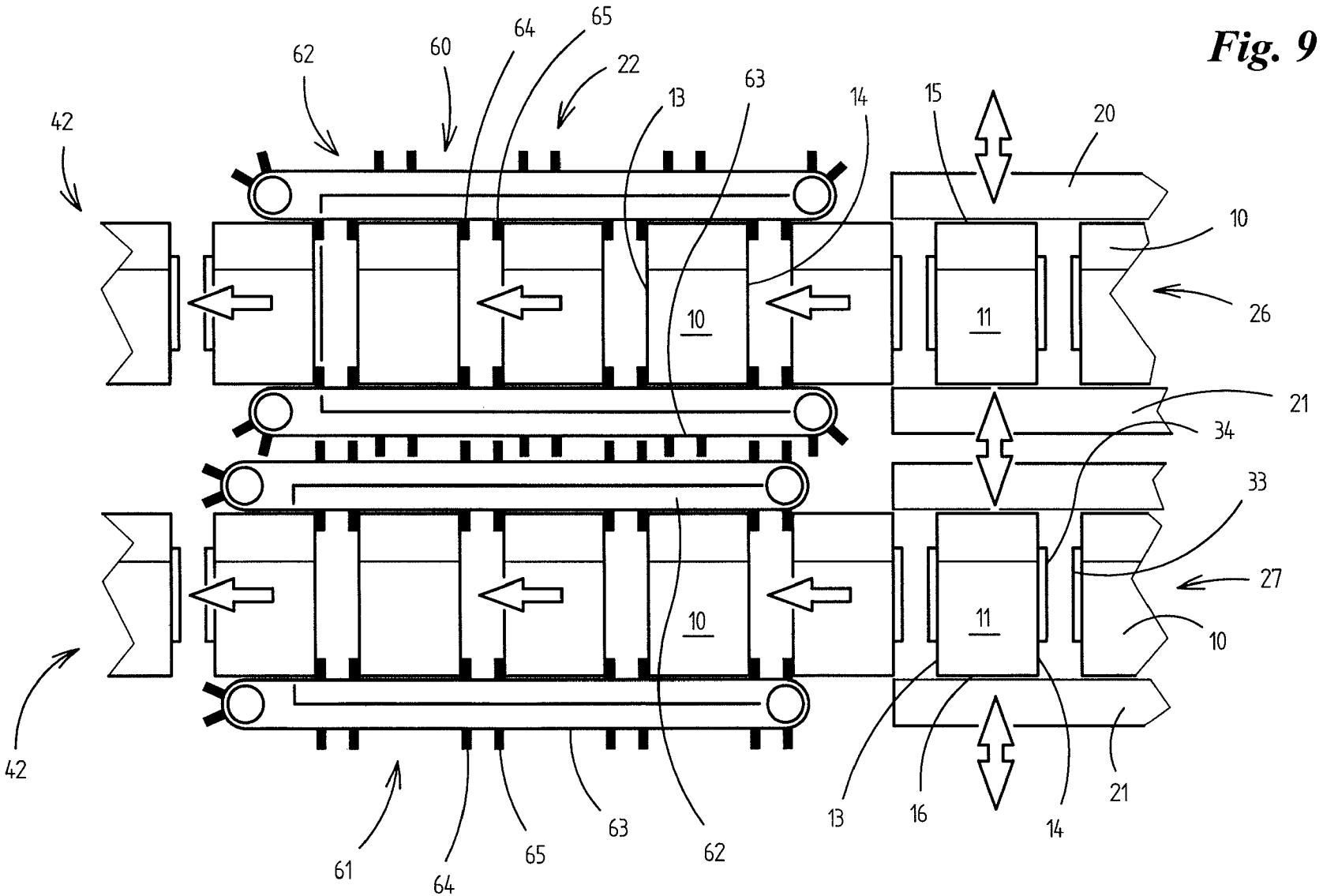
Figure 10:
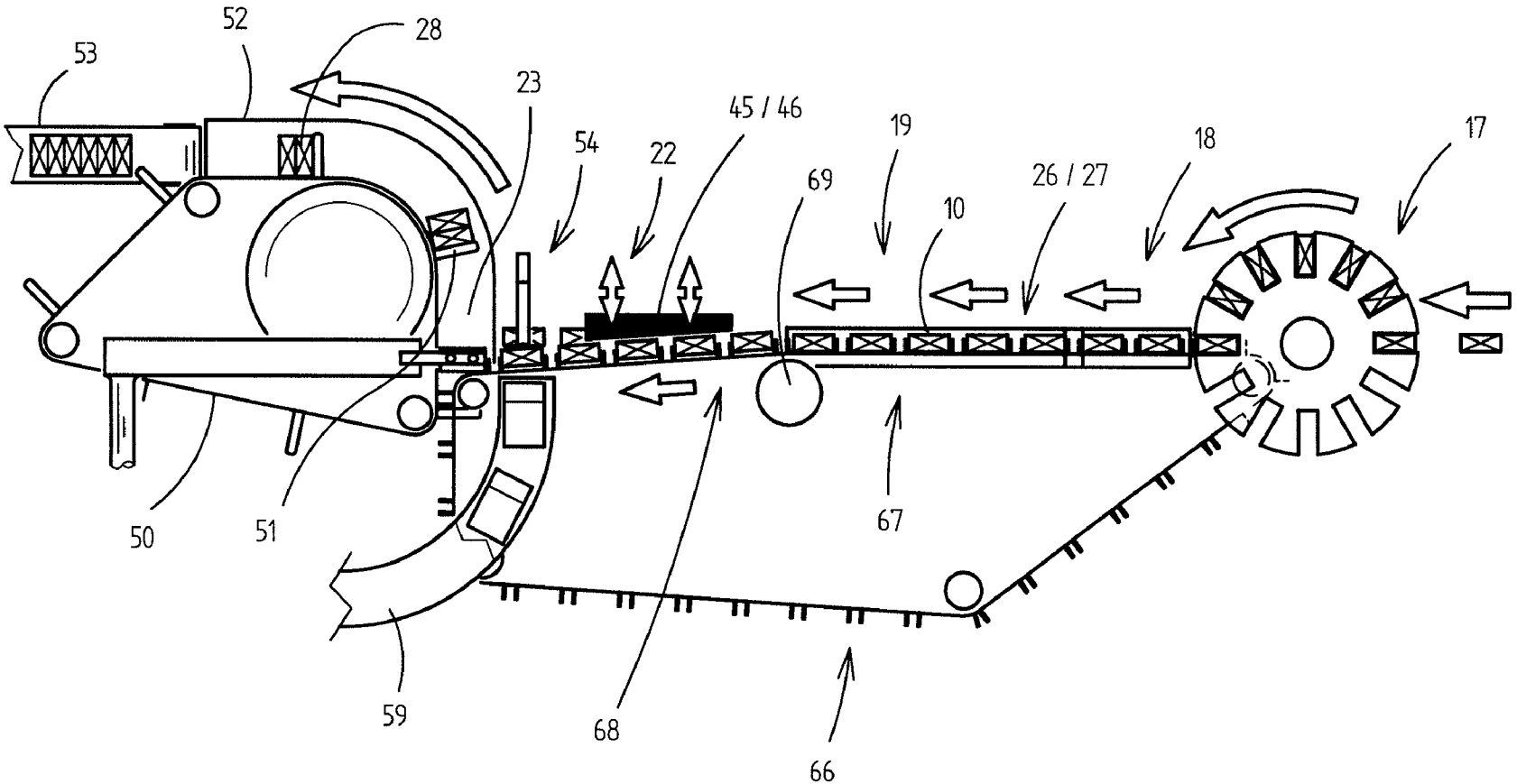

The method according to the invention and exemplary embodiments of the apparatus are explained in more detail below with reference to the drawings, in which:

FIG. 1 shows an apparatus for the treatment of (cigarette) packs as part of a packaging machine, in a schematic side view, FIG. 2 shows the apparatus according to FIG. 1 in a top view corresponding to the arrow II in FIG. 1, FIG. 3 shows a detail of the apparatus according to FIG. 1 and FIG. 2 in cross section and in a transverse view in the plane of FIG. 2 on an enlarged scale, FIG. 4 shows a detail of FIG. 2 in the transverse plane IV-IV of FIG. 2, likewise on an enlarged scale, FIG. 5 shows a particular region of pack conveyors in a side view, namely the detail V in FIG. 1, on an enlarged scale, FIG. 6 shows the detail according to FIG. 5 in the case of a changed position of elements, FIG. 7 shows a different exemplary embodiment of the apparatus in an illustration analogous to FIG. 1, FIG. 8 shows the apparatus according to FIG. 7 in a top view according to the arrow VIII in FIG. 7, FIG. 9 shows the region of a shrinkage station in FIG. 7 in a top view and in a horizontal section corresponding to the plane IX-IX in FIG. 7, on an enlarged scale, and FIG. 10 shows a different exemplary embodiment of the apparatus in a schematic side view corresponding to FIG. 1.

The exemplary embodiments are concerned with the treatment of cuboidal packs 10, namely cigarette packs of the hinge-lid-box type. The packs 10 are delimited by a large-surface-area front side 11, an opposite rear side 12, by side surfaces 13, 14 and by an end surface 15 and bottom surface 16. The (hard) packs 10, which are composed of thin cardboard, are surrounded by an outer wrapping of shrinkable film.

The packs 10 coming from a packaging machine are provided with the outer wrapping in the region of a film turret 17. Said outer wrapping is initially folded in a customary manner in a shape of a U around the pack 10 as it is inserted into a pocket of the film turret 17. Then, on the radially outer side surface 13, folding tabs of the film are connected to each other in the region of an overlap by means of sealing. Furthermore, first foldings of the film in the region of the end surface 15 and bottom surface 16 are completed.

Directly downstream of the film turret 17, the pack 10 passes into a rectilinear pack path. In the region thereof, the packs 10 first of all pass through a folding station 18 in which sideways directed folding tabs of the film wrapping are folded with customary end and bottom folds being formed.

This is followed by a sealing station 19. In the region therefore, the folding tabs or folds are connected to one another in the region of the sideways directed end surface 15 and bottom surface 16 by thermal sealing. For this purpose, sealing elements, namely elongated sealing jaws 20, 21 are arranged on both sides of the pack path. The latter come into contact with the facing pack surfaces 15, 16 during a momentary standstill of the packs as they are being conveyed cyclically. The sealing jaws 20, 21 are therefore movable to and fro in the transverse direction.

The packs 10 which are completed with regard to the outer film wrapping now pass into a shrinkage station 22. In the region thereof, heat is transmitted to the packs 10 in order to produce a shrinkage effect on the outer wrapping.

The finished packs 10 pass into the region of a grouping station 23. The packs 10 are subsequently supplied in formed groups to a multipacker which produces customary multipacks from pack groups.

The shrinkage station 22 is designed in such a manner that heat is transmitted to the large-surface-area pack sides, namely to the front side 11 and rear side 12, by heating elements, in particular by heating plates. During a treatment cycle, i.e. while the packs 10 are at a standstill, the heating plates preferably bear against the full surface area of said packs. For, this purpose, the packs 10 are conveyed in such a manner that the pack surface to be subjected to heat is exposed during the treatment. For this purpose, the packs 10 are conveyed in two pack rows 26, 27 running next to each other, to be precise, individual packs following one another at a distance, at least in the region of the shrinkage station 22, and as early as in the region of the sealing station 19 and therebefore in the region of the film turret 17 in the present exemplary embodiments. In the shrinkage station 22, the pack surfaces 11, 12 which are to be acted upon are kept free for contact by the respective heating plates by means of an appropriate design and manner of operation of pack conveyors. In the region of the grouping station 23, the mutually assigned packs 10 of the pack rows 26, 27 are brought together by a transverse movement in order to form a pack unit 28 comprising in each case two packs 10 lying one above the other.

In the present exemplary embodiments, the packs 10—coming from the packer—are supplied in two pack rows 26, 27 to the film turret 17. The latter is designed in such a manner that two corresponding sub-turrets 29, 30 for in each case one pack row 26, 27 are combined to form a unit and are then moved synchronously. Downstream of the film turret 17, the pack rows 26, 27 are guided through the folding station 18 and subsequently through the sealing station 19. In the folding station 18, folding elements are assigned to each pack row 26, 27, and also respective sealing jaws 20, 21 are arranged on both sides of the pack rows 26, 27.

In the exemplary embodiment according to FIG. 1 and FIG. 2, the shrinkage station 22 is designed in such a manner that the upwardly directed front side 11 and downwardly directed rear side 12 of the packs 10 are acted upon in consecutive substations by heating plates. Heating plates are assigned to each pack row 26, 27. In the first substation, heating plates 24, 25 are arranged below the path of movement of the pack rows 26, 27 such that the heating plates bear against the downwardly facing rear sides 12 of the packs 10. The heating plates 24, 25 are dimensioned in such a manner that, during a treatment cycle, a plurality of packs 10, namely three consecutive packs 10, of a pack row 26, 27 are acted upon simultaneously by contact by the heating plates 24, 25. The conveying cycles of the pack rows 26, 27 correspond in each case to one pack 10 such that the heat is transmitted to the packs 10 over a plurality of cycles (three).

In the following substation, heating plates 45, 46 are arranged above the pack rows 26, 27 such that the upwardly directed front side 11 is acted upon.

The pack conveyors for transporting the individual packs 10, with the two parallel pack rows 26, 27 being formed, are designed in a particular manner. In the exemplary embodiment according to FIG. 1 and FIG. 2, the packs are removed from the film turret 17 by a (first) pack conveyor 31, which is designed as an endless conveyor, and are transported by an upper conveyor strand 32 along a first portion of a conveyor section. The pack conveyor 31 is designed in such a manner that the packs 10 are positioned in a substantially fitting manner between carry-along means 33, 34 arranged at a distance from each other. The latter grasp each pack 10 on pack surfaces located at the front and rear in the transporting direction, namely on the side surfaces 13 and 14.

Each pack row 26, 27 is assigned one such pack conveyor 31. The latter run parallel to one another and are driven synchronously such that the packs 10 of the pack rows 26, 27 are transported in an aligned formation. After emerging from the film turret 17, the packs 10 are conveyed through the folding station 18 and subsequently through the sealing station 19. The latter extends into the region of the shrinkage station 22. The pack conveyor 31 ends at the shrinkage station 22.

Subsequently, namely particularly in the region of the heating plates 24, 25 acting on the lower side of the packs 10, the transportation of the packs 10 is taken over by a connecting conveyor assigned to each pack row 26, 27, to be precise by a respective upper conveyor 35. The latter is designed in an identical or similar manner to the pack conveyor 31, namely with transversely directed carry-along means 36, 37 for grasping the packs 10 at the side surfaces 13, 14. The packs are conveyed by a lower strand 38 in such a manner that the downwardly directed pack surfaces, namely the rear sides 12, are exposed for contact by the heating plates 24, 25.

The upper conveyor 35 is designed in such a manner that, when the heating plates 24, 25 are lowered, i.e. in particular during the conveying cycle, the packs 10 are held on the conveyor. For this purpose, the upper conveyor 35 is designed as a suction conveyor. The lower strand 38 is assigned a suction unit, namely a suction box 40. The latter is connected to a negative pressure source in such a manner that suction air is transmitted to the packs 10 at least during the conveying cycle. The belt of the upper conveyor 35 is of air-permeable design.

The packs 10 are transported only in the region of the first substation, i.e. in the region of the downwardly acting heating plates 24, 25, by the upper conveyor 35. The packs are then taken on by the lower conveyor 41, 42 as a subsequent pack conveyor, the lower conveyor transporting the packs in the region of the heating plates 45, 46 acting on the upper side. This (third) pack conveyor extends into the region of the grouping station 23. The lower conveyor 41, 42 is expediently designed like the pack conveyor 31 with an upper strand 43, 44 for transporting the packs 10 between front and rear drivers 33, 34.

The grouping station 23 following the shrinkage station 22 is designed in such a manner that packs 10 of the two pack rows 26, 27, which packs arrive in offset planes, are brought by transverse displacement into a position with packs arranged in pairs one above another (FIG. 4). The planes which are offset in height are provided by the feed conveyors for the packs 10, namely the lower conveyors 41, 42 and the upper strands 43, 44 thereof bringing about the height offset of the arriving packs 10 on account of being correspondingly inclined. For example, the upper strand 43 is inclined downward, the upper strand 44 is inclined upward, but may also run horizontally.

If heating plates 45, 46 are arranged in the region of the inclined upper strands 43 and/or 44, the shape of the heating plates is matched to the position of the packs 10, namely to the inclined conveying position. A contact surface of the heating plates 45, 46, which contact surface faces the pack surfaces (front side 11, rear side 12), is arranged obliquely corresponding to the inclination of the packs 10 such that the heating plates 45, 46 can bear over their entire surface area against the obliquely directed packs 10.

In the grouping station 23, the packs 10 are pushed in the transverse direction off the two upper strands 43, 44 by transverse conveyors, namely slides 47, 48, and are deposited lying one above another on a support, namely on a platform 49. The two-pack groups of packs 10 are taken from the latter by a removal conveyor 50, namely an endless conveyor, which grasps the packs 10 by means of carry-along means 51 supplied from below and transports them away. The packs 10 are transported along a guide 52 of curve design and are transferred in groups in an upright position to a belt conveyor 53 which conveys away the packs 10 between upright strands, in particular to a multipacker.

An ejection station 54 is arranged upstream of the grouping station 23 in the conveying direction, i.e. between shrinkage station 22 and grouping station 23. In the region of said ejection station, faulty packs identified during the manufacturing and transportation are separated out. The ejection station 54 is equipped with transverse conveyors 55, 56. The latter are designed as belt conveyors with carry-along means 57 arranged at suitable distances from one another. The transverse conveyors 55, 56 are arranged movably above the lower conveyors 41, 42, namely such that they are pivotable about a drive shaft 58. In this starting position (on the right, FIG. 3), the transverse conveyor 56 is located above the lower conveyors 41, 42 in the inoperative position. If a faulty pack passes into the region of the ejection station 54, the relevant transverse conveyor 55 is lowered into the conveying position and driven. As an alternative, the transverse conveyors 55, 56 can be permanently driven and only lowered into the active position if the need arises. The relevant pack 10 is supplied to an ejection shaft 59.

The concept of the exemplary embodiment according to FIG. 7 to FIG. 9 is similar to the concept of the exemplary embodiment according to FIG. 1. The individual packs 10 which were transported into paths are removed from the film turret 17 by the pack conveyor 31 and are supplied via the sealing station 19 to the shrinkage station 22. The latter is constructed in such a manner that the lower heating plates 24, 25, which are assigned to each pack row 26, 27, and the upper heating plates 45, 46 are arranged one above the other. As a result, the shrinkage station 22 is shorter. In order to supply the heat preferably simultaneously to the upper side and lower side of the packs 10, a special intermediate conveyor 60, 61 is required for transporting the packs 10 in the region of the heat elements in such a manner that the upper side and lower side of the packs 10 are exposed. The intermediate conveyors 60, 61 assigned to each pack row 25, 26 comprise two conveyor belts 62, 63, in each case on both side of the path of movement of the packs 10. The conveyor belts 62, 63 are designed with a small constructional width, i.e. with deflecting rollers of small diameter. The conveyor belts 62, 63 have transversely directed carry-along means 64, 65 which grasp the packs 10 on the front and rear side surfaces 13, 14. The distances between the carry-along means 64, 65 assigned to a pack 10 correspond to the dimensions of the pack 10 such that said packs are transported in a manner free from play. By means of the design and arrangement of the intermediate conveyor 60, 61, the front side 11 and the rear side 12 of the packs are free in the region of the heating plates 24, 25 and 45, 46.

In order to ensure a small distance between the two transporting paths for the packs 10, the intermediate conveyors 60, 61 and the conveyor belts 62, 63 of the two pack rows 26, 27 are arranged offset with respect to each other in the conveying direction (FIG. 9) in such a manner that the carry-along means 64, 65, which lie in pairs next to each other, protrude from the return strands of the mutually adjacent conveyor belts 62, 63 into the intermediate spaces of the respectively adjacent conveyor in an alternating manner.

Downstream of the shrinkage station 22 and of the intermediate conveyor 60, 61, the packs 10 are transported to the grouping station 23 by a further pack conveyor, namely by the lower conveyor 41, 42 which is formed with the shorter upper strand 43, 44. Said lower conveyor is designed analogously to the exemplary embodiment according to FIG. 1 and FIG. 2.

An apparatus having a lower technical outlay is shown in FIG. 10. The shrinkage station 22 merely comprises upper heating plates 45, 46 for the upper side, i.e. front side 11, of the packs 10 which are transported in two pack rows 26, 27. Given appropriate material for the outer wrapping for the packs, the supply of heat merely to the upper side of the packs 10 is sufficient in order to obtain a shrinkage effect.

The two pack rows 26, 27 are each assigned a pack conveyor 66 which conveys the packs 10 from the film turret 17 via the folding station 18, the sealing station 19, the shrinkage station 22 to the grouping station 23.

In the exemplary embodiment according to FIG. 10, an upper strand 67 of the pack conveyor 66 is divided into portions. An end portion 68 facing the grouping station 23 is guided via a deflecting roller 69 and inclined (downward). The heating plates 45, 46 are located in the region of said end portion 68 and are designed in the described manner if they are assigned to an end portion 68 running in an inclined manner. The heating plates 45, 46 have a trapezoidal cross section.

A further particular characteristic is the transfer of the packs 10 of a pack row 26, 27 from a pack conveyor to a subsequent pack conveyor. This characteristic is illustrated in FIG. 5 and FIG. 6 with reference to the example of FIG. 1. The two pack conveyors, namely the supplying pack conveyor 31 and the removing upper conveyor 35, are arranged with an alternating overlap on account of appropriate positioning of deflecting rollers 70, 71. The two conveyors are provided with carry-along means 33, 34, on the one hand, and 36, 37, on the other hand, which grasp the packs 10 on both sides. The mutually assigned carry-along means 33 . . . 37 differ in design with regard to their shape. In the case of the arriving conveyor, i.e. the pack conveyor 31, web-like carry-along means 33 which have a bead-like thickening 72 of rounded cross section at the outer, free edge are effective on the front side of the packs 10. Said thickening bears against the front side of the pack 10. The opposite carry-along means 34 is a transversely protruding web with a bevel 73 on the side facing the pack 10. The carry-along means 36, 37 are of corresponding design.

The arriving packs 10 are carried along by the pack conveyor 31 into the region of the upper conveyor 35 (FIG. 5). By means of the subsequent deflection of the conveying element, the front carry-along means 36 passes into an oblique position. The rear carry-along means 34 comes free from the pack 10 since, on account of the deflection of the upper conveyor 35 which is taking over the pack, the carry-along means 33 bears against the rear pack surface (by means of the thickening 72) and takes over the further transportation of the pack, to be precise initially until contact is made with the carry-along means 37 of the upper conveyor 35, which carry-along means bears against the front side. The pack 10 is therefore inserted between the carry-along means 36 and 37 of the upper conveyor 35 in a manner free from play. As the movement continues, the rear carry-along means 34 of the supplying pack conveyor 31 can be moved without contact past the transported-away pack 10, namely past a lower, rear pack edge, because of the bevel 73 (FIG. 6).

LIST OF REFERENCE NUMBERS

10 Pack
11 Front side
12 Rear side
13 Side surface
14 Side surface
15 End surface
16 Bottom surface
17 Film turret
18 Folding station
19 Sealing station
20 Sealing jaw
21 Sealing jaw
22 Shrinkage station
23 Grouping station
24 Heating plate
25 Heating plate
26 Pack row
27 Pack row
28 Pack unit
29 Sub-turret
30 Sub-turret
31 Pack conveyor
32 Conveyor strand
33 Carry-along means
34 Carry-along means
35 Upper conveyor
36 Carry-along means
37 Carry-along means
38 Lower strand
39
40 Suction box
41 Lower conveyor
42 Lower conveyor
43 Upper strand
44 Upper strand
45 Heating plate
46 Heating plate
47 Slide
48 Slide
49 Platform
50 Removal conveyor
51 Carry-along means
52 Guide
53 Belt conveyor
54 Ejection station
55 Transverse conveyor
56 Transverse conveyor
57 Carry-along means
58 Drive shaft
59 Ejection shaft
60 Intermediate conveyor
61 Intermediate conveyor
62 Conveyor belt
63 Conveyor belt
64 Carry-along means
65 Carry-along means
66 Pack conveyor
67 Upper strand
68 End portion
69 Deflecting roller
70 Deflecting roller
71 Deflecting roller
72 Thickened portion
73 Bevel

The invention claimed is:

1. Method for producing packs (10) with an outer wrapping of shrinkable film, wherein the packs (10) which are provided with the outer wrapping are transported through a shrinkage station (22) having heating elements (24, 25; 45, 46) for transmitting shrinkage heat to the packs (10), characterized by the following features:

a) the packs (10) are transported through the shrinkage station (22) in two parallel pack rows (26, 27) of individual packs (10) lying next to each other, b) downstream of the shrinkage station (22), adjacent, mutually assigned packs (10) of the two pack rows are brought together by transverse displacement with pack-groups of in each case two packs (10) lying one above the other being formed, and the pack rows (10) are transported in the region of the shrinkage station (22) on downwardly or upwardly inclined pack paths so that the mutually assigned packs (10) of the two pack rows (26, 27) are combined into planes of certain height exclusively by transverse displacement with respect to the pack group.

2. Method for producing packs (10) with an outer wrapping of shrinkable film, wherein the packs (10) which are provided with the outer wrapping are transported through a shrinkage station (22) having heating elements (24, 25; 45, 46), for transmitting shrinkage heat to the packs (10), characterized by the following features:

a) the packs (10) are transported through the shrinkage station (22) in two parallel pack rows (26, 27)of individual packs (10) lying next to each other, b) downstream of the shrinkage station (22), the adjacent, mutually assigned packs (10) of the two rows are brought together by transverse displacement with groups of in each case two packs (10) lying one above the other being formed, and the packs (10) are grasped at least in the region of the shrinkage station (22) and at least during their transportation by holding elements, exclusively outside downwardly or upwardly directed pack surfaces which are acted upon by the heating elements.

3. An apparatus for producingpacks (10) with an outer wrapping of shrinkable film, which packs, downstream of a packaging machine, can be first of all conveyed through a sealing station (19) for sealing folding tabs of the outer wrapping and then is conveyed through a shrinkage station (22) for transmitting heat, which brings about the shrinkage of the outer wrapping, to the packs (10), characterized by the following features:

a) a transporter transporting the packs (10), at least in the region of the shrinkage station (22), in two pack rows (26, 27) of in each case individual packs (10), b) downstream of the shrinkage station (22), a displacer displacing at least one pack (10) of mutually assigned, adjacent packs (10) of the two pack rows (26, 27) by transverse movement with a pack group of two packs (10) lying one above the other being formed, the packs (10) are transported by conveyors which are on the lower side of the packs (10) in the region of action of heating plates (24, 25), and which comprise an upper conveyor (35) which fixes the packs (10) thereon when the heating plates (24, 25) are lowered, and a suction box (40), in the region of a lower strand (38), on which the packs (10) are held at least during transportation.

4. An apparatus for producing packs (10) with an outer wrapping of shrinkable film, which packs, downstream of a packaging machine, can be first of all conveyed through a sealing station (19) for sealing folding tabs of the outer wrapping and then is conveyed through a shrinkage station (22) for transmitting heat, which brings about the shrinkage of the outer wrapping, to the packs (10), characterized by the following features:

a) a transporter transporting the packs (10), at least in the region of the shrinkage station (22), in two pack rows (26, 27) of in each case individual packs (10), b) downstream of the shrinkage station (22), a displacer displacing at least one pack (10) of mutually assigned, adjacent packs (10) of the two pack rows (26, 27) by transverse movement with a pack group of two packsjl0) lying one above the other being formed, and the shrinkage station (22) is formed from lower heating plates (24, 25) and upper heating plates (45, 46) which are substantially aligned with respect to one another and are movable simultaneously in order to transmit heat toward the lower side or toward the upper side of the packs (10), the packs (10) being transportable, at least in the region of the heating plates (24, 25; 45, 46), by conveyors (60, 61) which do not grasp the packs (10) in the region of the upper side and lower side, and which comprise conveyor belts (62, 63) which are arranged laterally next to the pack rows (26, 27) and grasp the packs (10) only in the region of a rear pack side.

5. The apparatus as claimed in claim 4 , characterized in that the conveyor belts (62, 63) which revolve in a horizontal plane are arranged with laterally directed carry-along means (64, 65) on both sides of each pack row (26, 27), with an offset in the conveying direction, so that the carry-along means (64, 65) of mutually facing return strands of the conveyor belts (62, 63) arranged between the two pack rows (26, 27) enter intermediate spaces in an alternating manner.

* * * * *